US007497622B2

(12) United States Patent
Kozak

(10) Patent No.: US 7,497,622 B2
(45) Date of Patent: Mar. 3, 2009

(54) ENCLOSURE FOR PRESERVING PERISHABLE GOODS

(76) Inventor: Burton Kozak, 1300 N. Lake Shore Dr., No. 28C, Chicago, IL (US) 60610

( * ) Notice: Subject to any disclaimer, the term of this patent is extended or adjusted under 35 U.S.C. 154(b) by 632 days.

(21) Appl. No.: 11/100,691

(22) Filed: Apr. 7, 2005

(65) Prior Publication Data

US 2005/0259895 A1 Nov. 24, 2005

Related U.S. Application Data

(63) Continuation-in-part of application No. 10/386,979, filed on Mar. 12, 2003, now abandoned.

(51) Int. Cl.
*B65D 33/16* (2006.01)
*B65D 33/01* (2006.01)

(52) U.S. Cl. ..... 383/61.2; 383/63; 383/100; 383/103

(58) Field of Classification Search ..... 383/63, 383/61.2, 100, 103, 64
See application file for complete search history.

(56) References Cited

U.S. PATENT DOCUMENTS 5,142,970 A * 9/1992 ErkenBrack ..... 99/472
5,511,884 A * 4/1996 Bruno et al. ..... 383/63
5,544,752 A * 8/1996 Cox ..... 206/524.8
5,839,582 A * 11/1998 Strong et al. ..... 206/524.8
6,045,264 A * 4/2000 Miniea ..... 383/41
6,085,906 A * 7/2000 Lambert ..... 206/524.8
6,231,236 B1 * 5/2001 Tilman ..... 383/61.2
6,341,688 B1 * 1/2002 Graham ..... 206/63.5
6,955,465 B2 * 10/2005 Machacek et al. ..... 383/63
7,270,479 B2 * 9/2007 Nelson ..... 383/63
2004/0177595 A1 * 9/2004 Kozak ..... 53/434

FOREIGN PATENT DOCUMENTS

JP 03212355 A * 9/1991

* cited by examiner

*Primary Examiner*—Jes F Pascua

(57) ABSTRACT

An enclosure for preserving perishable goods includes an inner portion for removably receiving perishable goods, an outer portion that removably receives a vacuum device such as a vacuum cleaner which removes air from the enclosure after the goods have been inserted into the inner portion, a sealable outer seal that provides an air tight boundary between the enclosure and an end portion of the vacuum device to promote the removal of air from the enclosure, and a sealable inner seal that provides an air tight boundary for the inner portion and the goods therein after the removal of air from the enclosure and while the vacuum device remains engaged with the outer seal; the vacuum device being separated from the outer seal after the removal of air from the inner portion and the air tight sealing of the inner seal whereby the perishable goods are encased in a vacuum sealed inner portion of the enclosure to preserve the perishable goods after the goods are frozen. An alternative enclosure includes an opening, a first locking seal disposed relatively close and substantially parallel to the opening, a second locking seal disposed adjacent and parallel to the first locking seal, a third locking seal disposed adjacent and parallel to the second locking seal, and an aperture disposed in a first side portion of the enclosure adjacent to the second locking seal to enable an air evacuation tube to snugly insert through the first side portion of the enclosure.

14 Claims, 17 Drawing Sheets

ENCLOSURE FOR PRESERVING PERISHABLE GOODS

This is a Continuation-In-Part Application of application Ser. No. 10/386,979, filed on Mar. 12, 2003, now abandoned.

BACKGROUND OF THE INVENTION

1. Field of the Invention

The present invention relates to enclosures that encase perishable food goods such as "leftovers" from a large dinner for freezing and more particularly, to deformable enclosures such as freezer bags that have the air removed from an inner portion containing the goods, then sealed air tight thereby "vacuum packing" the goods for freezing.

2. Background of the Prior Art

Freezer bags and other deformable enclosures are routinely used to encase perishable goods before freezing. When freezer bags are used, it is common practice to place the goods in the bag without removing the air in the bag before freezing. This practice results in the food becoming damaged when left in a frozen state for long periods of time. There are deformable food enclosures designed to cooperate with relatively expensive vacuum devices to remove air from the enclosure. The problem with these food enclosure designs is that the enclosures and device are cumbersome to use and store, expensive and difficult to operate.

Therefore, a deformable enclosure is required that is common and inexpensive such as a standard freezer bag, and that can utilize a common vacuum device such as a home vacuum cleaner to remove the air from the enclosure. Further, the portion of the enclosure encasing the food must be capable of being sealed air tight while the vacuum cleaner is inside the enclosure, and a predetermined distance between portions of the enclosure proximate to an air removal port of the vacuum cleaner must be maintained to prevent the enclosure from being sucked into the port when the vacuum cleaner is energized.

SUMMARY OF THE INVENTION

It is an object of the present invention to overcome many of the disadvantages associated with removing air from enclosures to preserve perishable goods.

A principle object of the present invention is to provide an enclosure that allows a vacuum device such as a home vacuum cleaner to remove air from the enclosure. A feature of the enclosure is that it is deformable. An advantage of the enclosure is that an open portion can tightly engage an end portion of the vacuum device that includes an air removal port.

Another object of the present invention is to prevent air from entering the enclosure as the end portion of the vacuum device is removed from the enclosure. A feature of the enclosure is inner and outer internal seals that form inner and outer portions in the enclosure. An advantage of the enclosure is that only the outer seal engages the vacuum device thereby allowing the inner seal to be closed before the vacuum device is removed from the outer seal to maintain the vacuum in the inner portion where the perishable goods are disposed.

Yet another object of the present invention is to provide sealing members that congruently engage the air removal or end portion of the vacuum device to facilitate a tight seal between the end portion and the outer seal of the enclosure. A feature of the enclosure is allowing first and second ridges of the outer seal to gradually diverge from a sealed position to ultimately engage the periphery of the end portion. Another feature of the enclosure is opposing planar side walls that extend from a base portion of the sealing members to ultimately converge to form an edge that snugly engages a sealed portion of the outer seal. An advantage of the enclosure is that a smooth transition occurs for the outer seal from a closed to a fully open cylindrical configuration to prevent a small opening that would otherwise occur between the sealed portion of the outer seal and the cylindrical end portion of the vacuum device.

Another object of the present invention is to separate the enclosure from the air removal port of the end portion of the vacuum device a distance that prevents the enclosure from obstructing air removal by the vacuum device from the inner and outer portions of the enclosure. A feature of the enclosure is to provide sealing members with opposing inner and outer parallel side walls separated a distance that disposes the inner side wall inside the outer portion of the enclosure between the inner and outer seals, and that disposes the outer side wall beyond the outer seal between griping flaps. An advantage of the enclosure is to prevent a portion of the enclosure from being sucked into the air removal port of the vacuum device irrespective of the suction force generated by the vacuum device. Another advantage of the enclosure is to maintain vacuum in an inner portion of the enclosure by maintaining engagement between the converging side walls and first and second ridges of the outer seal irrespective of the vibration generated by the vacuum device.

Another object of the present invention is to remove air from the enclosure via a seal. A feature of the enclosure is first, second and third seals. Another feature of the enclosure is an aperture disposed adjacent to said second locking seal. An advantage of the enclosure is that an air evacuation tube is inserted into the aperture to remove air from the enclosure via the second seal thereby completely removing air from the portion of the enclosure containing perishable goods.

Briefly, the invention provides an enclosure for preserving perishable goods comprising an inner portion for removably receiving perishable goods; an outer portion that removably receives a vacuum device that promotes the removal of air from said enclosure after the perishable goods have been inserted into said inner portion; outer seal means for providing an air tight seal between said enclosure and the vacuum device to promote the removal of air from said enclosure; and inner seal means for providing an air tight seal for said inner portion and the goods therein after the removal of air from said enclosure and while the vacuum device remains engaged with said outer seal means, the vacuum device being separated from said outer seal means after the removal of air from said inner portion and the air tight sealing of said inner seal means whereby the perishable goods are encased in a vacuum sealed inner portion of said enclosure to preserve the perishable goods after freezing the goods.

The invention further provides an enclosure for preserving perishable goods comprising a plastic bag with an opening; a first locking seal disposed relatively close and substantially parallel to said opening; a second locking seal disposed adjacent and parallel to said first locking seal; a third locking seal disposed adjacent and parallel to said second locking seal, said third locking seal having dimensions substantially similar to said first locking seal, said third locking seal forming an inner portion for removably receiving perishable goods; and an aperture disposed in a first side portion of said enclosure adjacent to said second locking seal, said aperture enabling an air evacuation tube to snugly insert through said first side portion and between two first ridges of said second locking seal whereby an air removal device removes air from said enclosure after perishable goods are placed in said inner portion and said first locking seal is closed, whereupon said third locking seal is closed followed by said second locking seal closing from a second side of said enclosure to said first side of said enclosure until the evacuation tube is forcibly squeezed from said enclosure via said aperture, the sealing of said second locking seal preventing air from re-entering said enclosure via said aperture.

The invention further provides a freezer bag comprising a first seal having two first ridges that snugly receive an opposite second ridge; a second seal having two first ridges that snugly receive an opposite second ridge; a third seal having two first ridges that snugly receive an opposite second ridge; and an air evacuation tube secured to an end portion of said second seal.

The invention further provides a vacuumed enclosure for preserving food comprising a first seal disposed adjacent and parallel to an opening; a second seal disposed adjacent and parallel to said first seal, said second seal defining an outer portion of said enclosure; a third seal disposed adjacent and parallel to said second seal, said third seal defining an inner portion of said enclosure for receiving food and a middle portion of said enclosure; and means for removing air from said enclosure via said second seal such that said outer, inner and middle portions of said enclosure contain vacuums.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
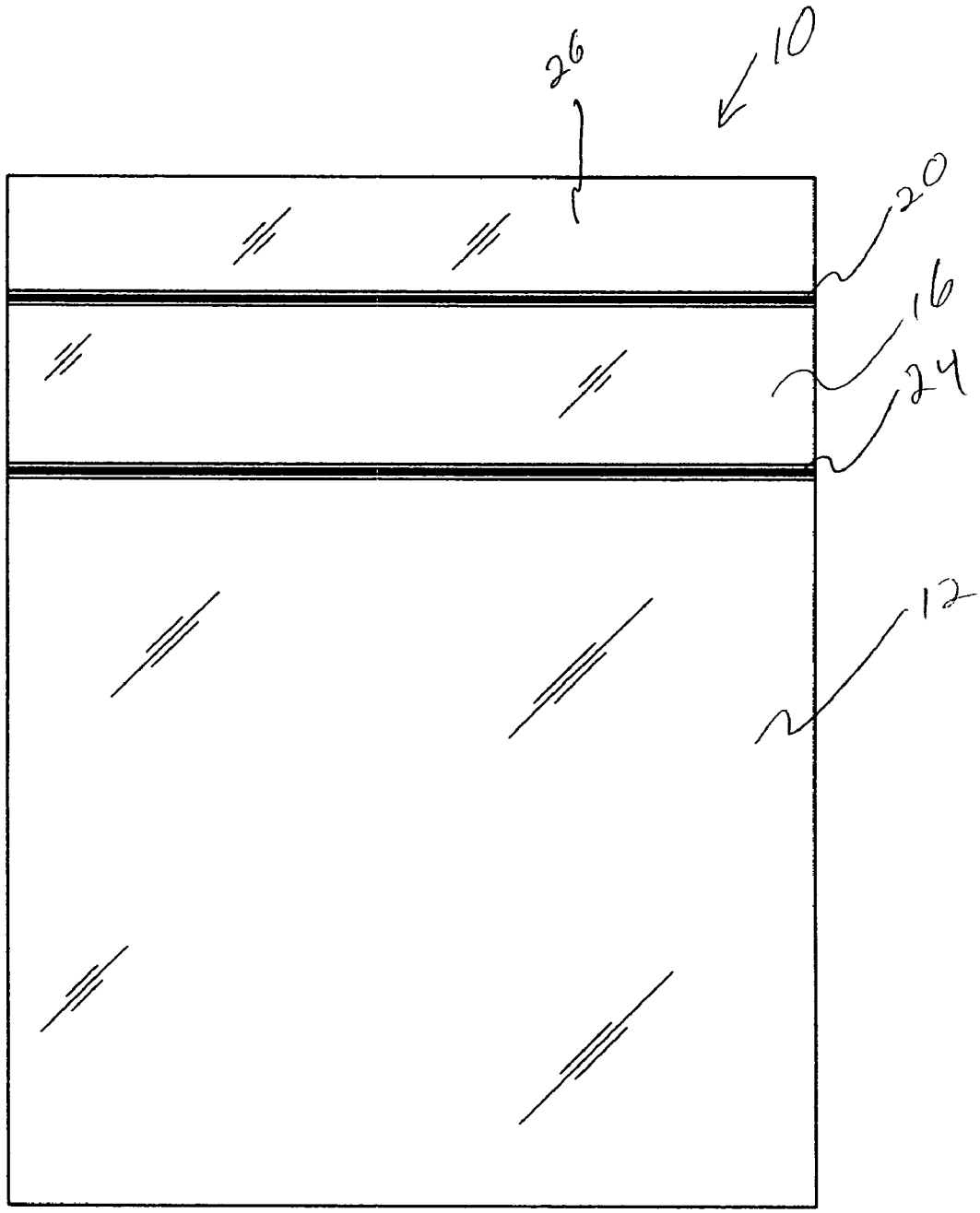
FIG. 1 is a front elevation view of an enclosure for preserving perishable goods in accordance with the present invention.
Figure 2:
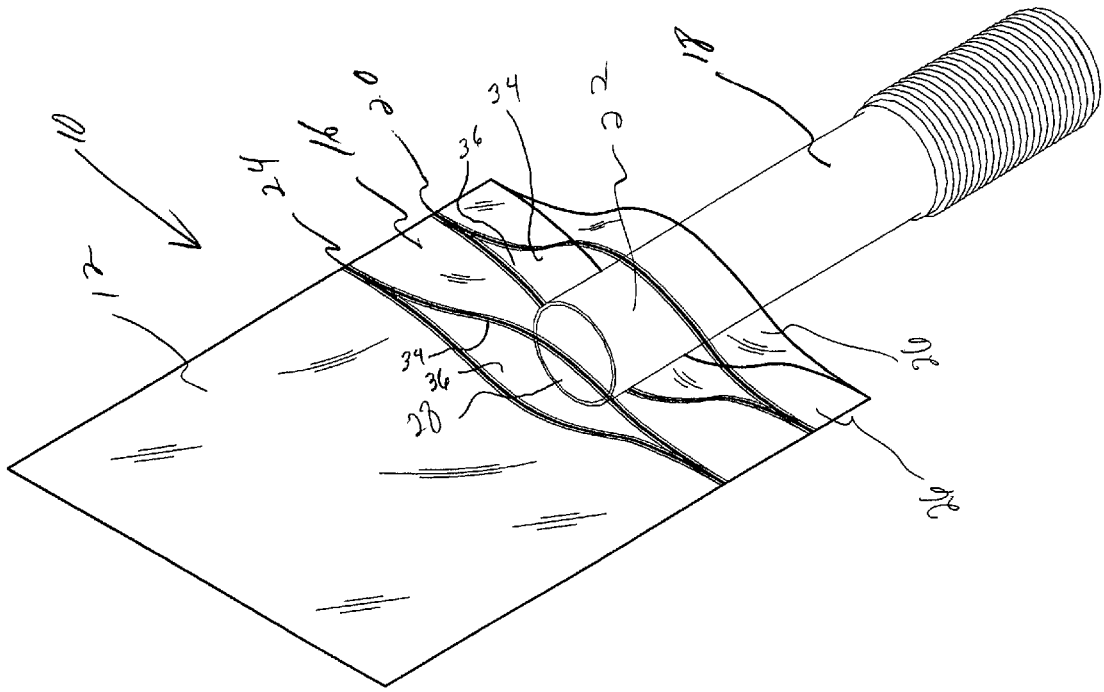
FIG. 2 is a perspective view of the enclosure of FIG. 1 with a vacuum device inserted between open inner and outer seals.
Figure 3:
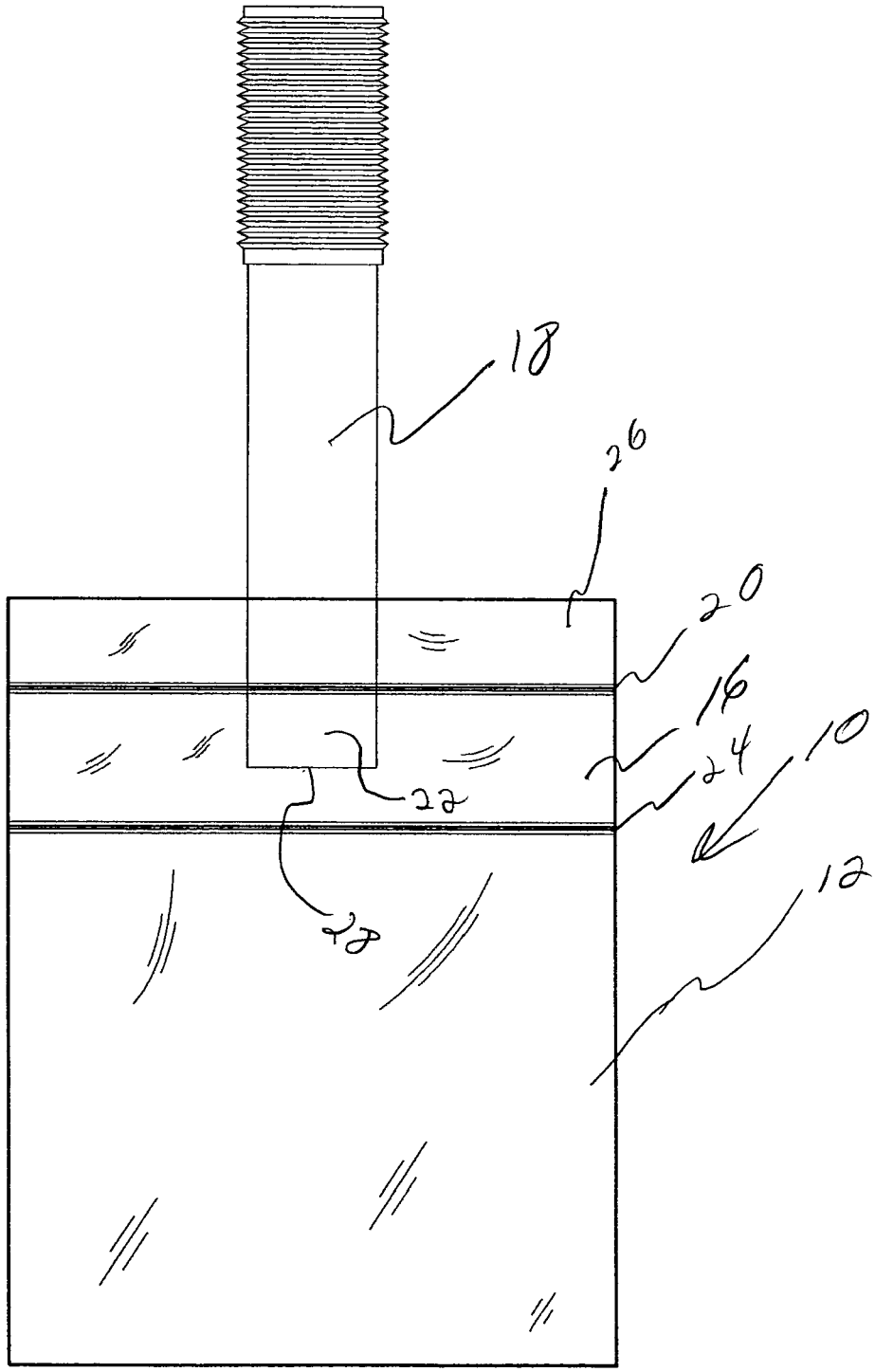
FIG. 3 is a front elevation view of the device of FIG. 2.
Figure 4:
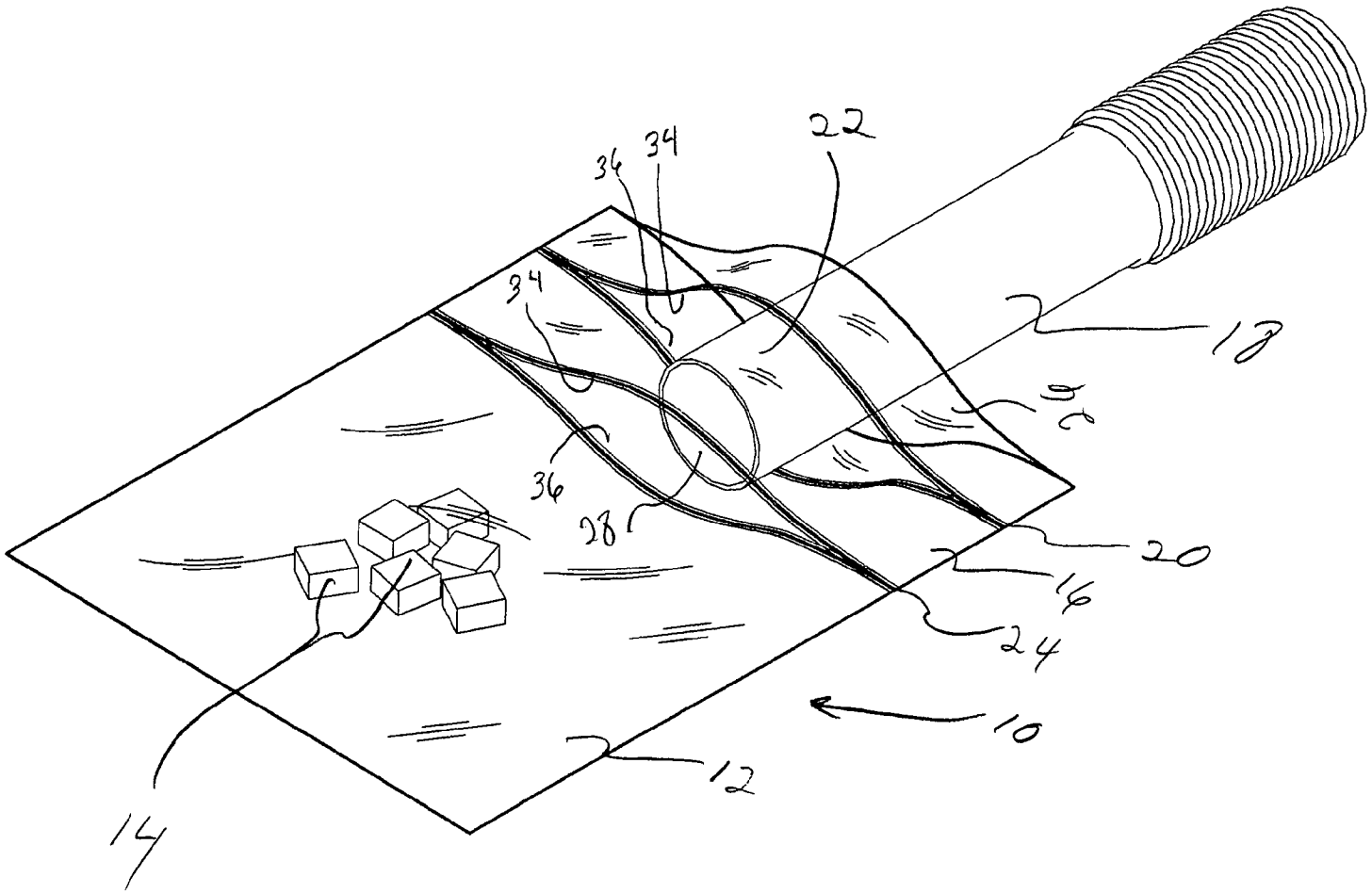
FIG. 4 is the perspective view of FIG. 2 with perishable goods disposed in an inner portion in accordance with the present invention.

Referring now to the figures and in particular to FIGS. 1-6, a transparent enclosure for preserving perishable goods is denoted by numeral 10. The enclosure 10, which includes freezer bag configurations, is fabricated from plastic or similar deformable material that is light weight and relatively durable when exposed to temperatures ranging from freezing to boiling. The enclosure 10 includes an inner or first portion 12 for removably receiving perishable goods 14, an outer or second portion 16 that removably receives a vacuum or air removing device 18 such as a vacuum cleaner, which removes air from the enclosure 10 after the perishable goods 14 have been inserted into the inner portion 12, a re-sealable outer seal 20 that provides an air tight boundary between the enclosure 10 and an end portion 22 of the vacuum device 18 to promote the removal of air from the enclosure 10, and an internal, re-sealable inner seal 24 that provides an air tight boundary for the inner portion 12 and the goods 14 therein after the removal of air from the enclosure 10 and while the vacuum device 18 remains engaged with the outer seal 20; the vacuum device 18 being separated from the outer seal 20 after the removal of air from the inner portion 12 and the air tight sealing of the inner seal 24 whereby the perishable goods 14 are encased in a vacuum sealed inner portion 12 of the enclosure 10 to preserve the perishable goods 14 after freezing the goods 14.

The enclosure 10 can be dimensioned to encase any perishable goods 14, but typically ranges from a "sandwich" size to a much larger "meal" size that is capable of holding an entire dinner. The enclosure 10 further includes opposing gripping flaps 26 that are integrally joined to the outer seal 20 and dimensioned to provide a means for a person to grip the enclosure 10 and separate the outer seal 20 after the enclosure 10 and the contents therein have been frozen. Once the outer seal 20 has been opened, it is relatively easy to open the inner seal 24 even when the enclosure 10 and contents therein are frozen.

The vacuum device 18 includes, but is not limited to, a vacuum cleaner having a hose with a tubular end portion 22 that typically includes a cylindrical configuration with an air removal port 28. The vacuum device 18 possesses sufficient power to facilitate the removal of air from the enclosure 10, but not so much power so as to result in the enclosure 10 being sucked into the end portion 22.

Figure 6:
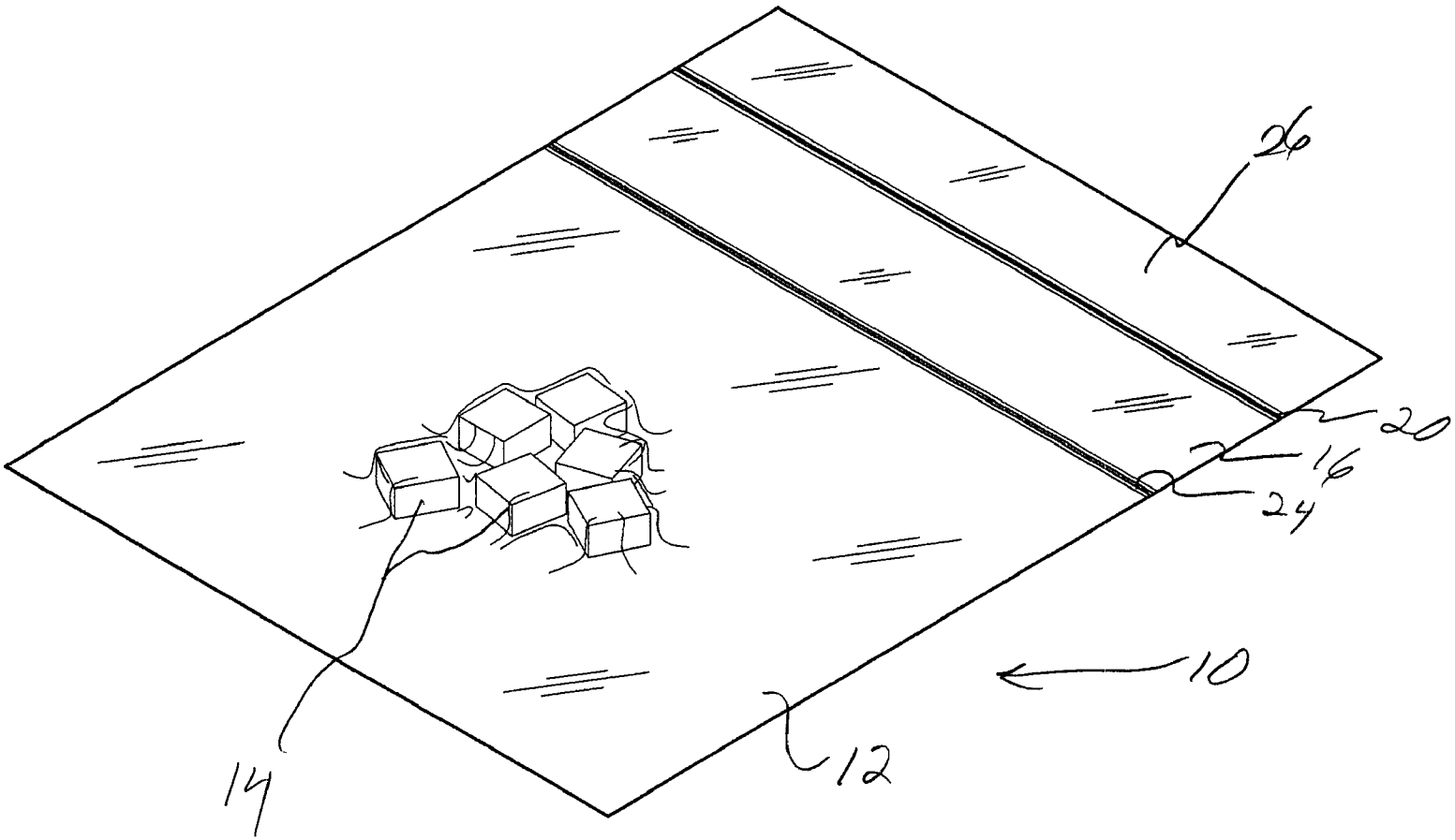
FIG. 6 is the perspective view of FIG. 5 with the vacuum device removed, the inner and outer seals closed and the inner and outer portions having substantially all air removed therefrom in accordance with the present invention.
Figure 7:
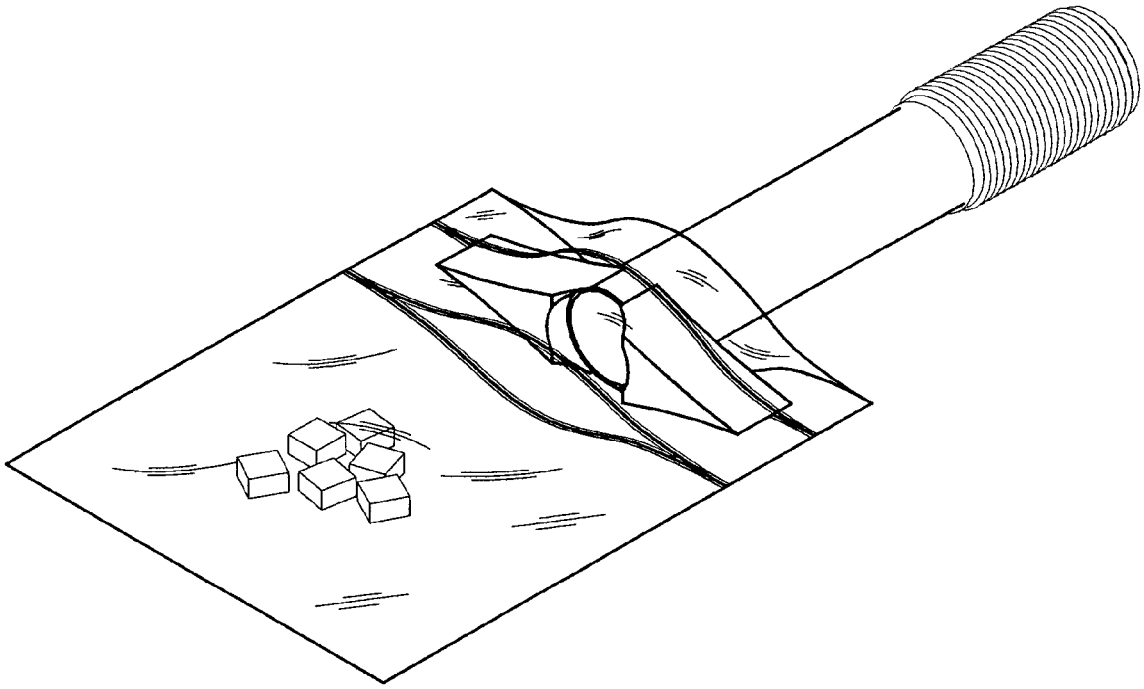
FIG. 7 is a cutaway side view of the inner and outer seals of the enclosure in an open position.
Figure 8:
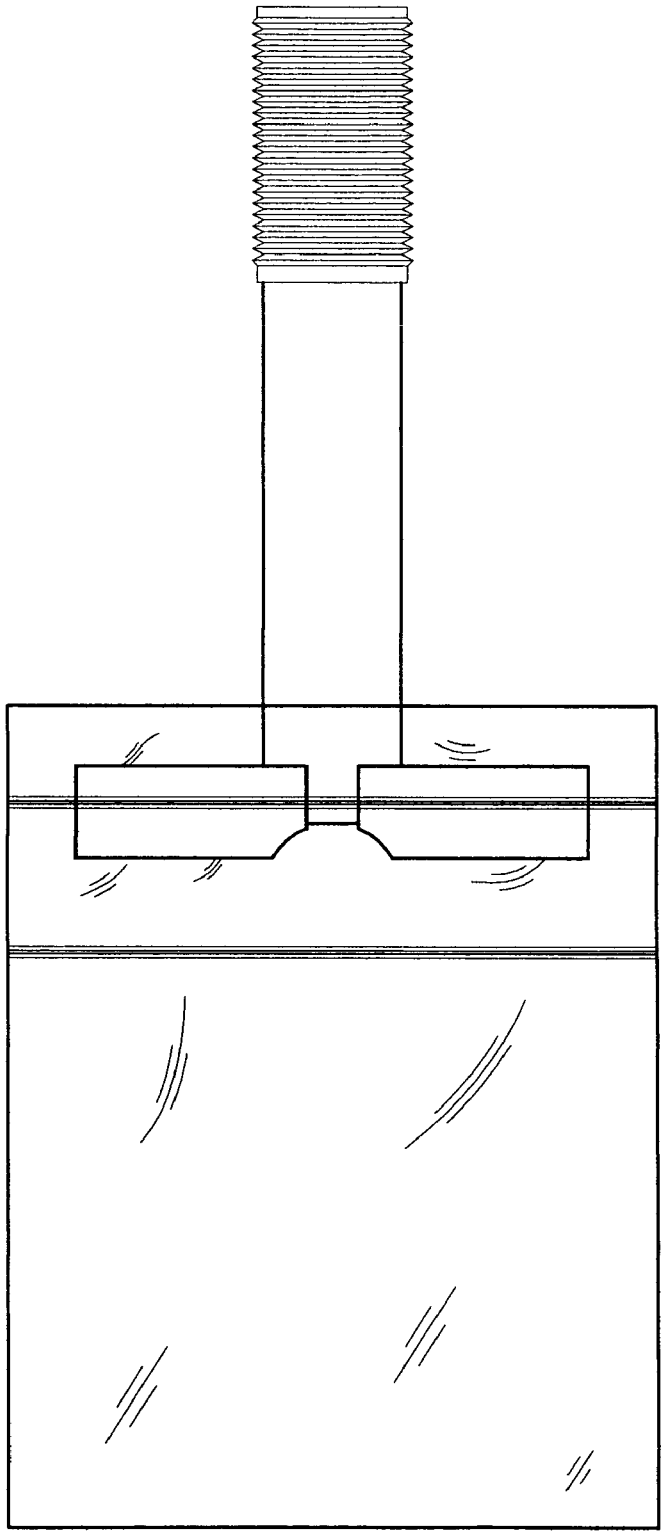
FIG. 8 is a cutaway side view of the inner and outer seals of the enclosure in a closed position.

Referring to FIGS. 1, 6 and 7, the inner portion 12 is sized to received preselected goods 14 such that when the goods 14 are inserted into the inner portion 12, a sufficient inner portion 12 volume remains to minimize deformation and obstruction of the inner seal 24 thereby facilitating an air tight boundary between the inner and outer portions 14 and 18. The inner seal 24 is typical of the seals used for single seal freezer bags and includes opposing first and second ridges 30 and 32 integrally joined to inner first and second walls 34 and 36 of the enclosure 10. The first ridge 30 includes two relatively firm, plastic protuberances extending perpendicularly from the first inner wall 34, a distance that promotes the complete insertion of the opposing relatively firm second ridge 32, which extends perpendicularly from the inner second wall 36, between the two protuberances of the first ridge 30 (see FIG. 8).

Referring to FIGS. 2-5, the outer portion 16 is sized to receive the end portion 22 of the vacuum device 18 such that the air removal port 28 is disposed at substantially a central portion of the outer portion 16 with the air removal port 28 being spaced from the inner seal 24 a distance that facilitates the unobstructed sealing of the inner seal 24 while the end portion 22 remains disposed between the outer and inner seals 20 and 24. The outer seal 20 is typical of the seals used for single seal freezer bags and includes the same configuration as the inner seal 24. More specifically, opposing first and second ridges 30 and 32 are integrally joined to inner first and second walls 34 and 36 of the enclosure 10. The first ridge 30 includes two relatively firm, plastic protuberances extending perpendicularly from the first inner wall 34, a distance that promotes the complete insertion of the opposing second ridge 32, which extends perpendicularly from the inner second wall 36, between the two protuberances of the first ridge 30 (see FIGS. 7 and 8).

Figure 5:
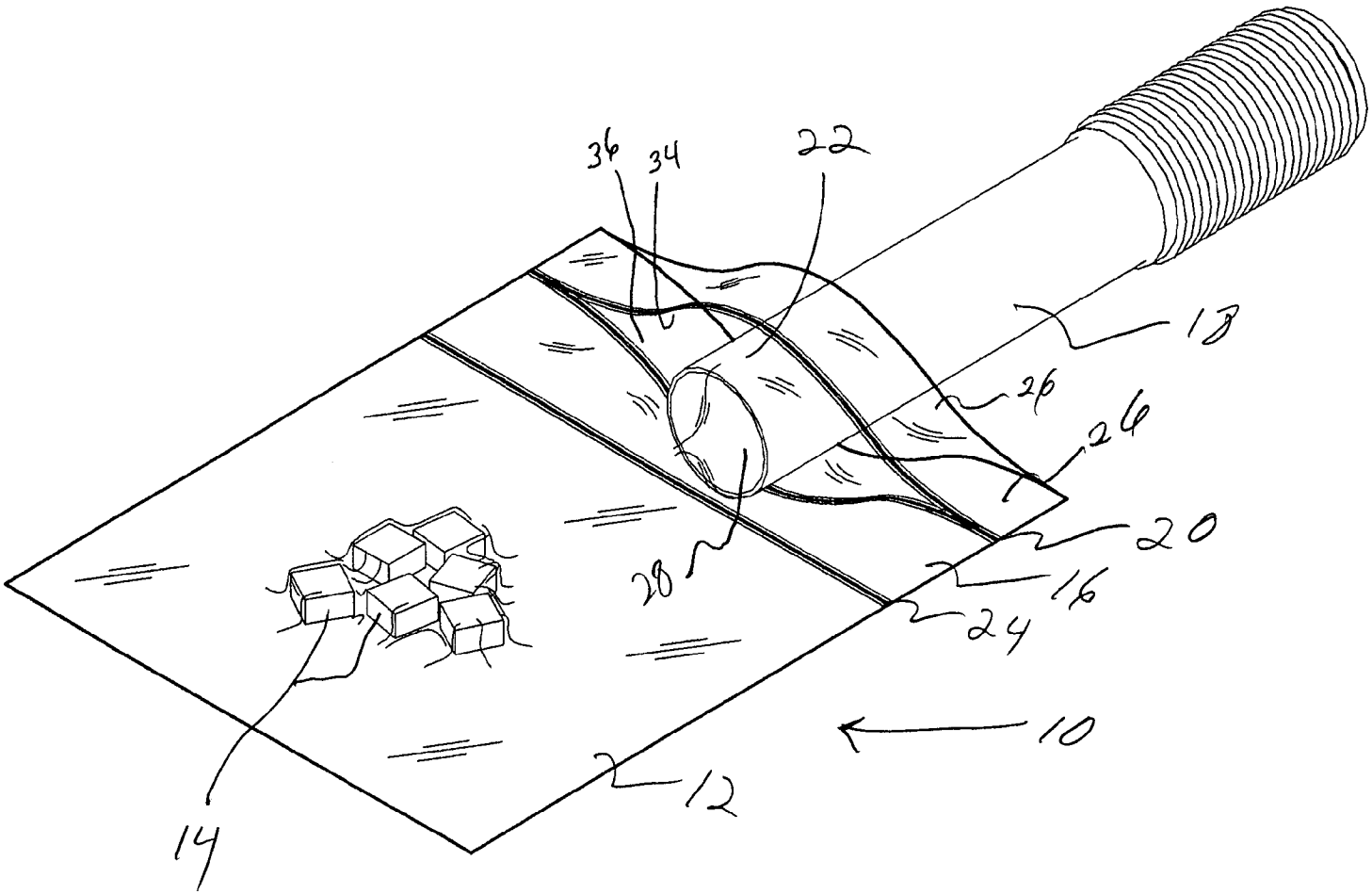
FIG. 5 is the perspective view of FIG. 4 with the inner seal closed and the inner portion having substantially all air removed therefrom in accordance with the present invention.

In operation, a freezer bag type enclosure 10 is selected to receive perishable goods 14 having a predetermined size and quantity. The outer and inner seals 20 and 24 are opened to allow the goods 14 to be disposed in an inner portion 12 of the enclosure 10. Next, an end portion 22 of a vacuum device 18 is positioned between the outer and inner seals 20 and 24 such that an air removal port 28 is disposed at a central portion of an outer portion 16 of the enclosure 10. The outer seal 20 is then closed such that the periphery of the end portion 22 of the vacuum device 18 is tightly and continuously engaged by the outer seal 20 to maintain an air tight seal even with the end portion 22 of the vacuum device 18 protruding through the outer seal 20. The vacuum device 18 is then energized to remove all air from the inner and outer portions 12 and 16 of the enclosure 10 thereby forcing the enclosure to collapse upon the goods 14 as depicted in FIG. 5, whereupon, the inner seal 24 is closed to provide an air tight barrier between the inner and outer portions 12 and 16 resulting in vacuum packed perishable goods 14. The end portion 22 of the vacuum device 18 is then removed from the outer portion 16 and the outer seal 20 is closed to provide a second barrier to air that might engage the perishable goods 14. The enclosure 10 and its contents are then frozen to preserve the goods 14 until the enclosure 10 is unsealed and the goods 14 removed for consumption.

Figure 9:
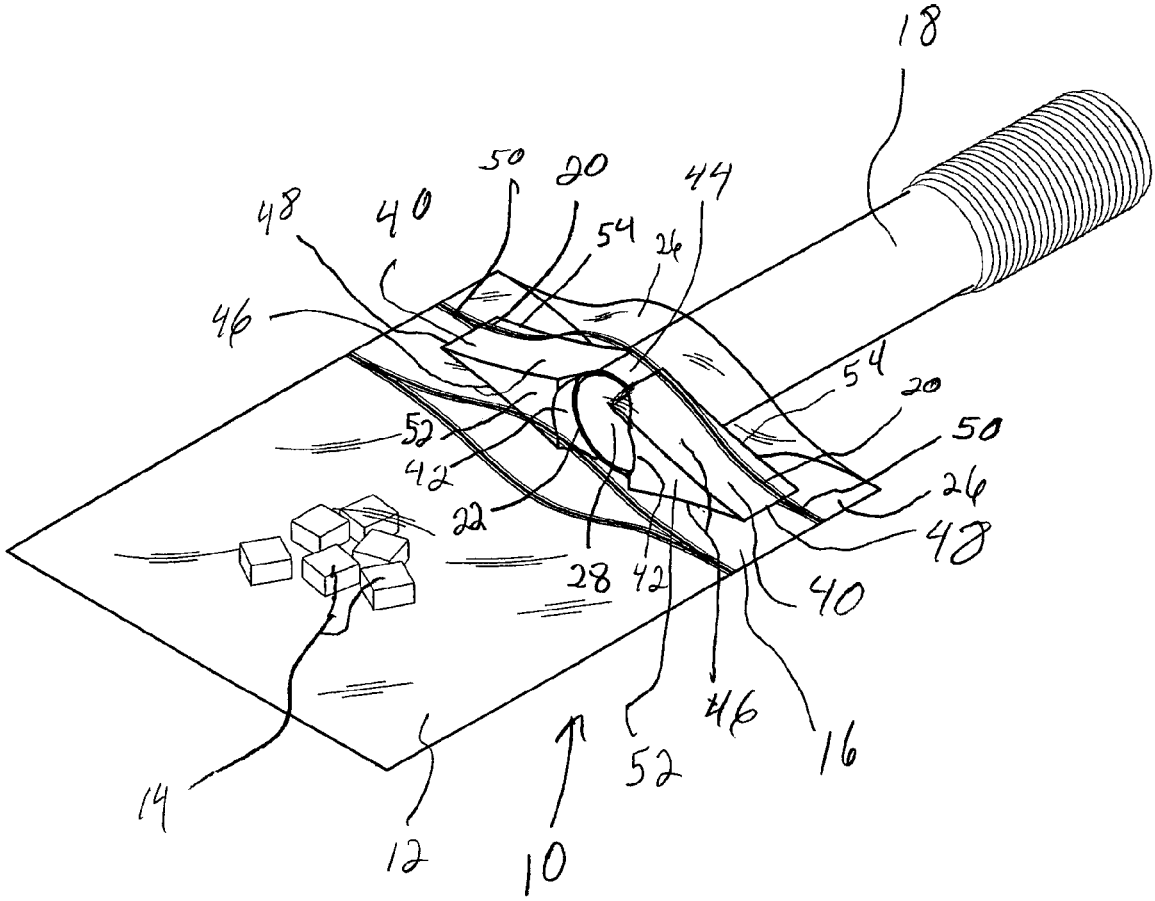
FIG. 9 is the perspective view of FIG. 4 with sealing members disposed inside the enclosure between the outer seal and an end portion of the vacuum device in accordance with the present invention.
Figure 10:
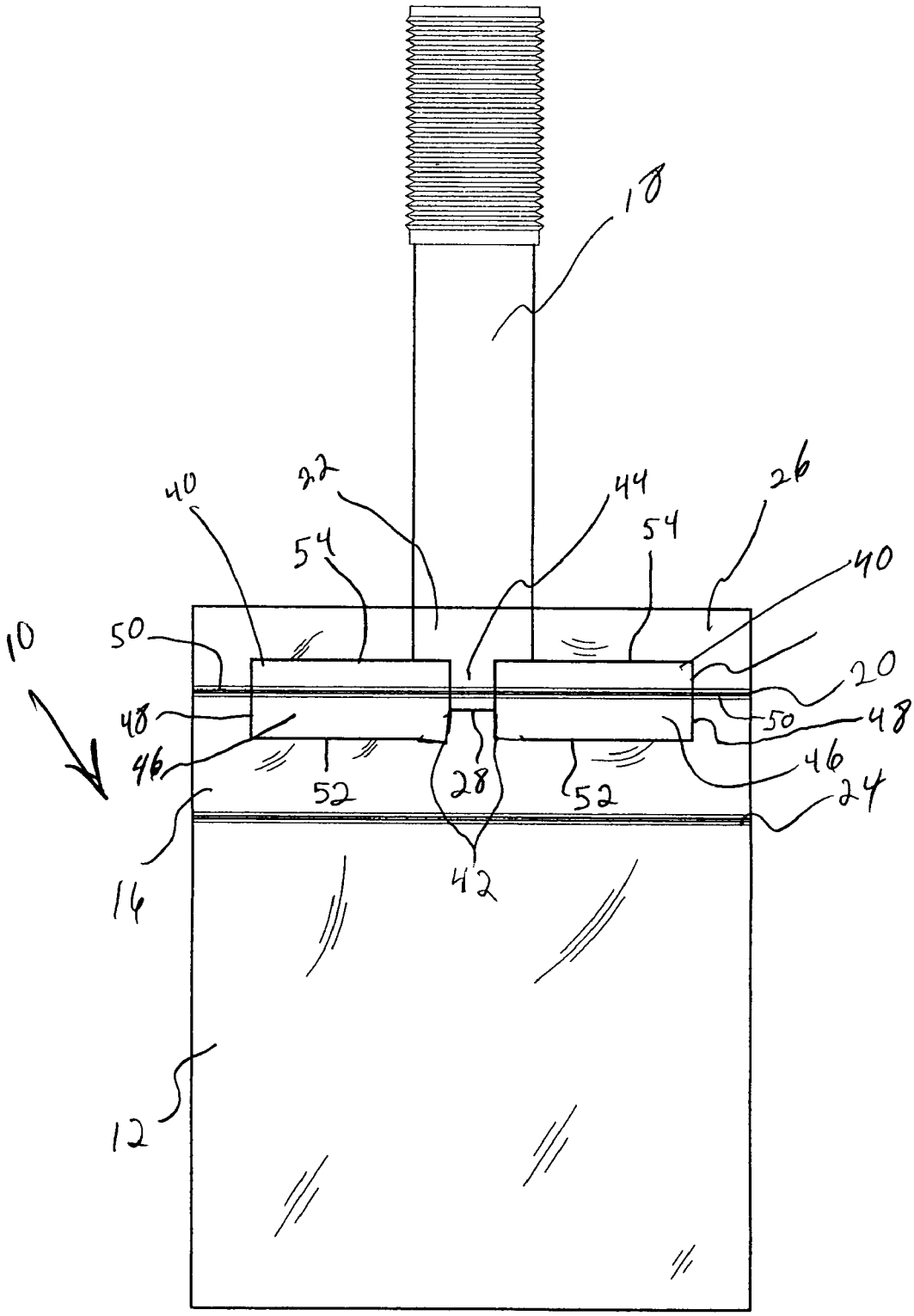
FIG. 10 is a front elevation view of FIG. 9 with the perishable goods removed.
Figure 11:
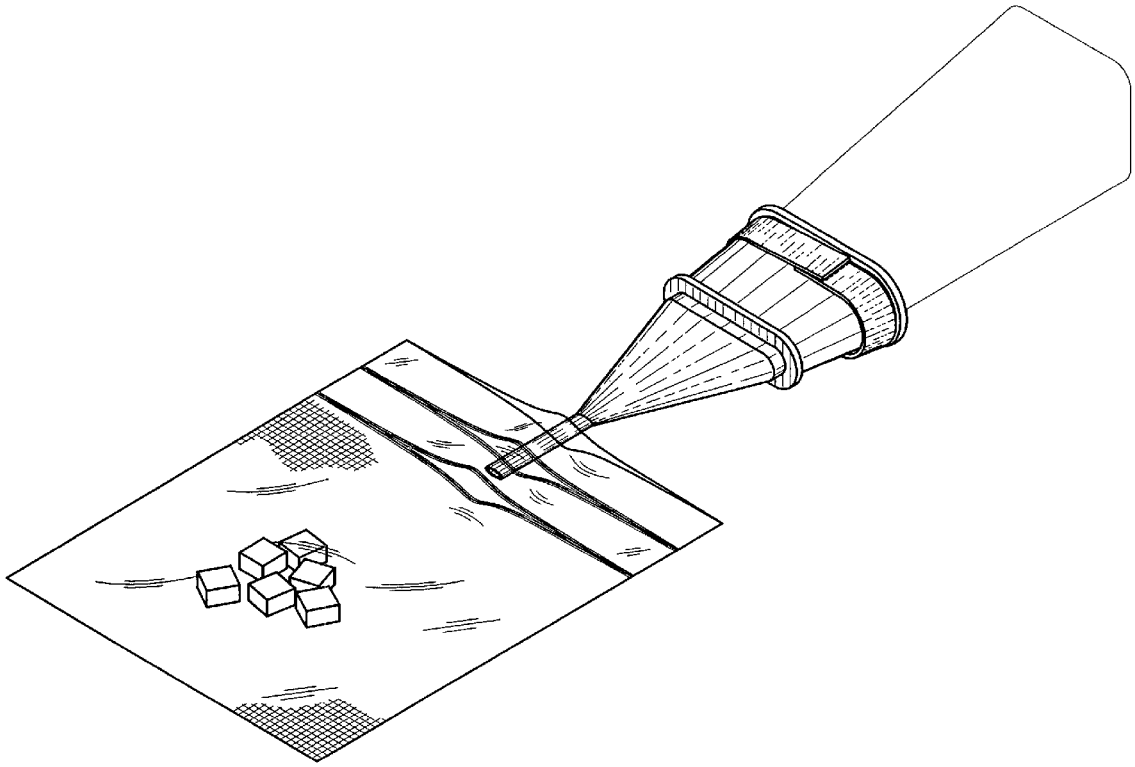
FIG. 11 is a perspective view of the enclosure of FIG. 1 with an alternative suction device inserted between open inner and outer seals in accordance with the present invention.

Referring now to FIGS. 9 and 10, two sealing members 40 are depicted congruently engaging an air removal or end portion 22 of the vacuum device 18 to facilitate a tight seal between the end portion 22 and the outer seal 20 of the enclosure 10 by allowing the first and second ridges 30 and 32 of the outer seal 20 to gradually diverge or separate from a sealed position to engagement with respective inclined converging side walls 46 of the sealing members 40 and also with the periphery of the end portion 22. The gradual diverging of the ridges 30 and 32 provides a smooth transition for the outer seal 20 from a closed to an open configuration that seals about a small portion of the end portion 22 of the vacuum device 18. Without the two sealing members 40, a tight outer seal 20 would be difficult to achieve due to the cylindrical configuration of the periphery of the end portion 22, resulting in small openings between the sealed portion of the outer seal 20 and the end portion 22.

The sealing members 40 are fabricated from a relatively firm material such as rubber. The sealing members 40 have a relatively triangular configuration that includes an arcuate base portion 42 that congruently engages a cylindrically configured outer side wall 44 of the end portion 22 of the vacuum device 18. The sealing members 40 further include opposing planar side walls 46 that extend from the base portion 42 and ultimately converge to form an edge 48 that snugly engages a sealed portion 50 of the outer seal 20. The converging side walls 46 have a lateral dimension that separates opposing inner and outer parallel side walls 52 and 54 a distance that disposes the inner side wall 52 inside the outer portion of the enclosure a distance that prevents the outer portion 16 of the enclosure 10 from being sucked into the air removal port 28 of the end portion 22 of the vacuum device 18 irrespective of the air removal force generated by the vacuum device 18; and that disposes the outer side wall 54 sufficiently beyond the outer seal 20 between the gripping flaps 26 to maintain engagement between the converging side walls 46 and the first and second ridges 30 and 32 of the outer seal 20 irrespective of the vibration generated by the vacuum device 18.

Referring now to drawings 11 and 12, an alternative hand held vacuum or suction device for removing air from the freezer bag 10 in conformance with the present invention, is denoted as numeral 70. The alternative device 70 includes a hand held vacuum portion 72, well known and commercially available, that includes an end portion 74 with an orifice (not pictured), a funnel member 76 that is joined to a connection member 78 which is secured to the end portion 74 via a securing strap 80 made from velcro or similar self locking material, and a tube member 82 having a sufficient longitudinal dimension to dispose an orifice 84 within the outer portion 16 of the bag 10 while the funnel member is disposed beyond the gripping flaps 26.

The connection member 78 is fabricated from plastic or similar material and functions as an interfacing device for the suction device 70 and the funnel member 76, also fabricated from plastic. The connection member 78 is tightly secured to the suction device 70 by the strap 80 upon snugly sliding an end portion 81 of the connection member 78 upon a cooperating portion of the device 70. The connection member 78 slidably receives the funnel member 76 by snugly inserting an end portion 83 of the funnel member 76 into a relatively larger receiving end 86 of the connection member 78.

The tube member 82 is integrally joined to the funnel member 76 and is ultimately disposed such that the orifice 84 is positioned between the outer and inner seals 20 and 24 thereby facilitating the removal of air from the inner portion 12 of the bag 10. The tube member 82 is fabricated from plastic and, when taking an end view, configured in the shape of an oval with a substantially larger longitudinal axis relative to a lateral axis thereby providing a substantially "flattened" tube that facilitates a tight outer seal 20 when the first and second ridges 30 and 32 are separated to engage the tube member 82 when removing air from the inner portion 12 of the bag 10. The orifice 84 has a relatively small cross-sectional area thereby limiting the vacuum capability of the vacuum portion 72 to prevent the inner portion 12 of the bag 10 from being drawn into the tube member 82 when using a relatively powerful vacuum portion 72.

Figure 12:
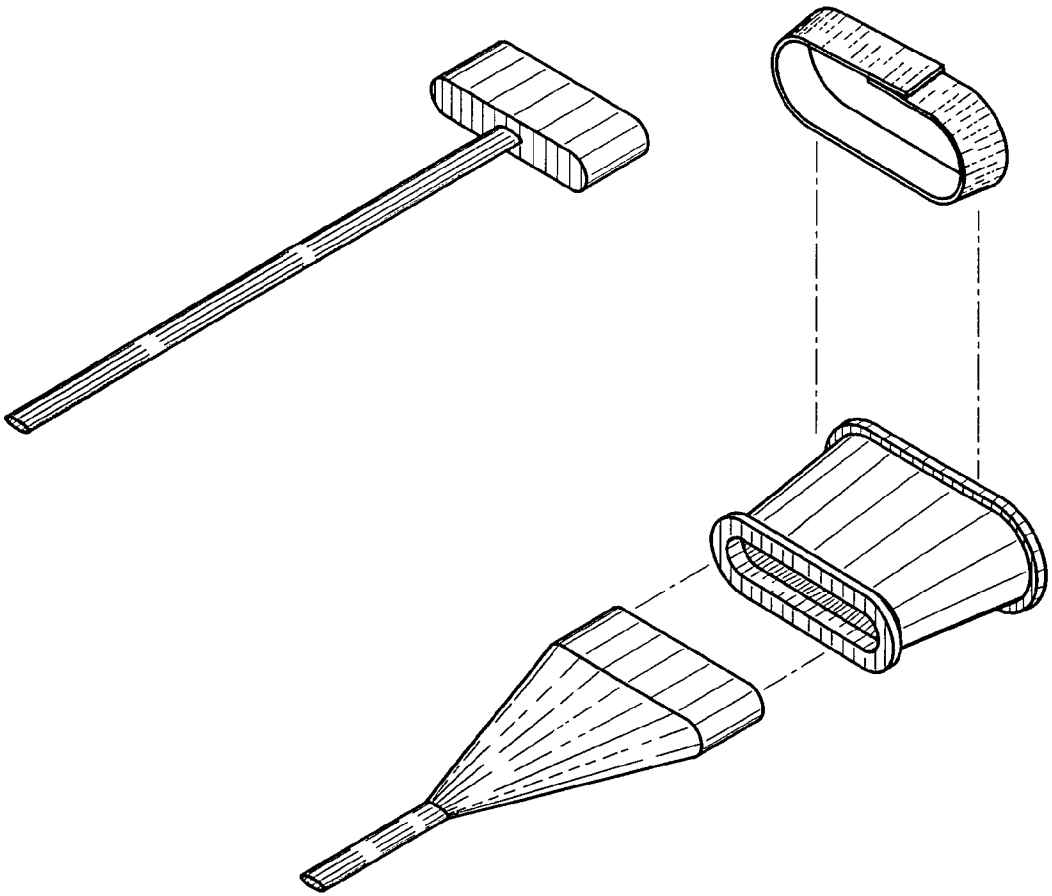
FIG. 12 is an exploded perspective view of funnel and connection members of the alternative suction device of FIG. 11.
Figures 12A, 12B:
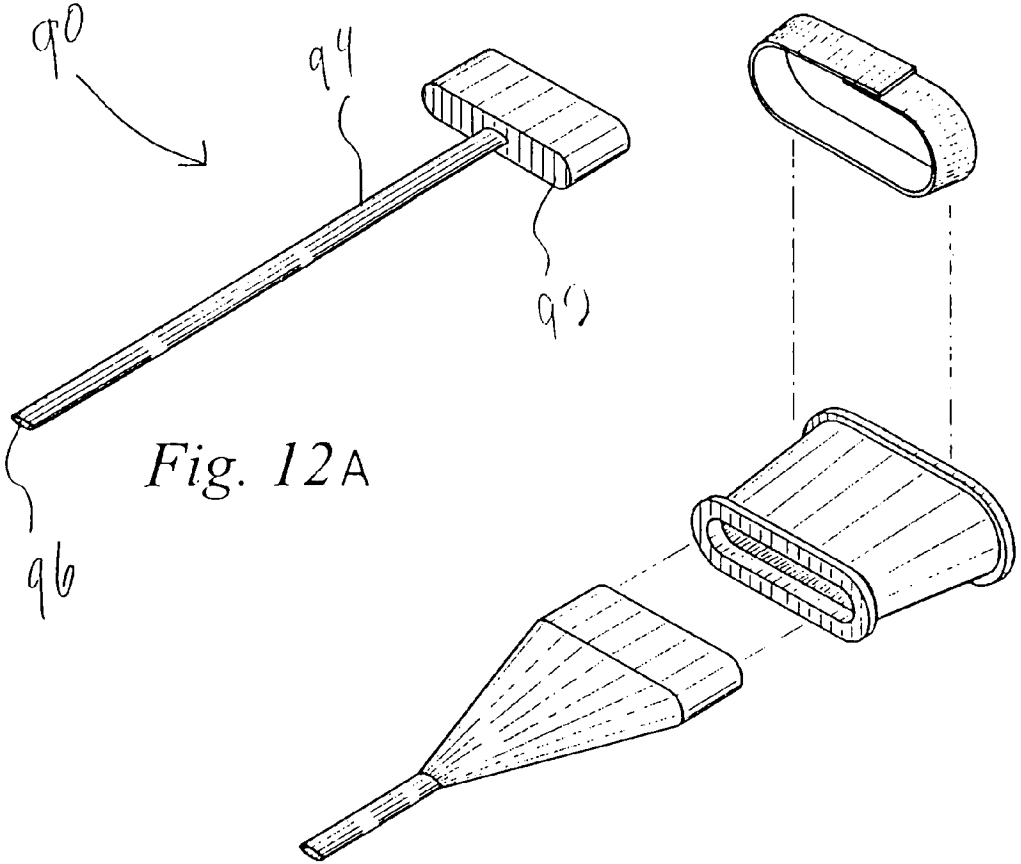
FIG. 12*a* and 12*b* are a perspective view of an alternative design for the funnel and connection members of FIG. 12 in accordance with the present invention.

Referring now to FIG. 12*a*, an alternative design for the suction device 70 in accordance with the present invention, is depicted and denoted as numeral 90. The alternative design 90 includes a connecting member 92 configures to snugly insert into a suction orifice in the vacuum portion 72, and an extension tube 94 integrally joined to the connecting member 92. The extension tube 94 is substantially longer than the tube 82 of the alternative suction device 70 to allow an operator to grasp the tube 94 while removing air from the inner portion 12 of a bag 10 via an orifice 96 which includes the same cross-sectional configuration as the alternative device tube member 82.

Figure 13:
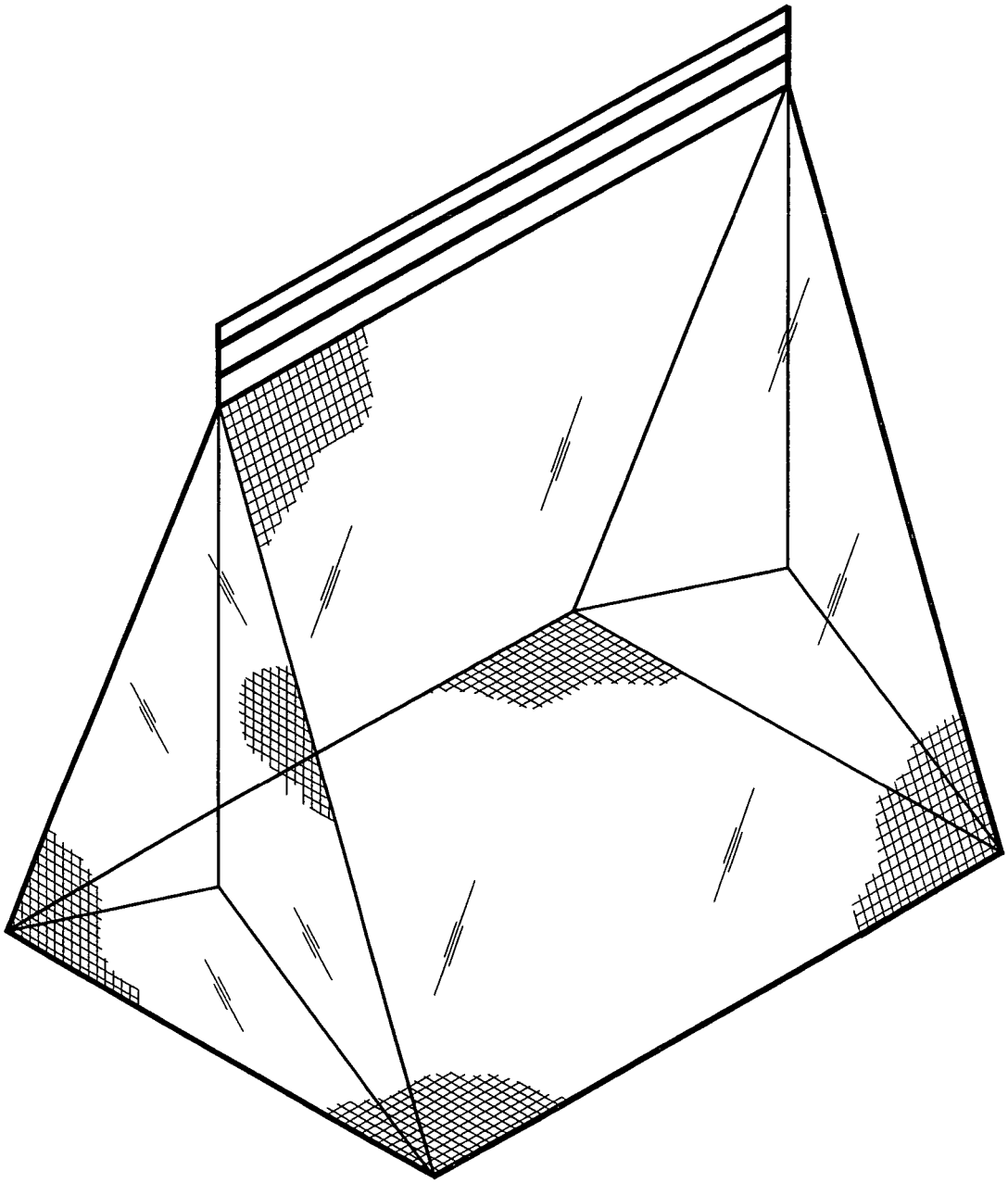
FIG. 13 is a perspective view of an alternative freezer bag in accordance with the present invention.
Figure 14:
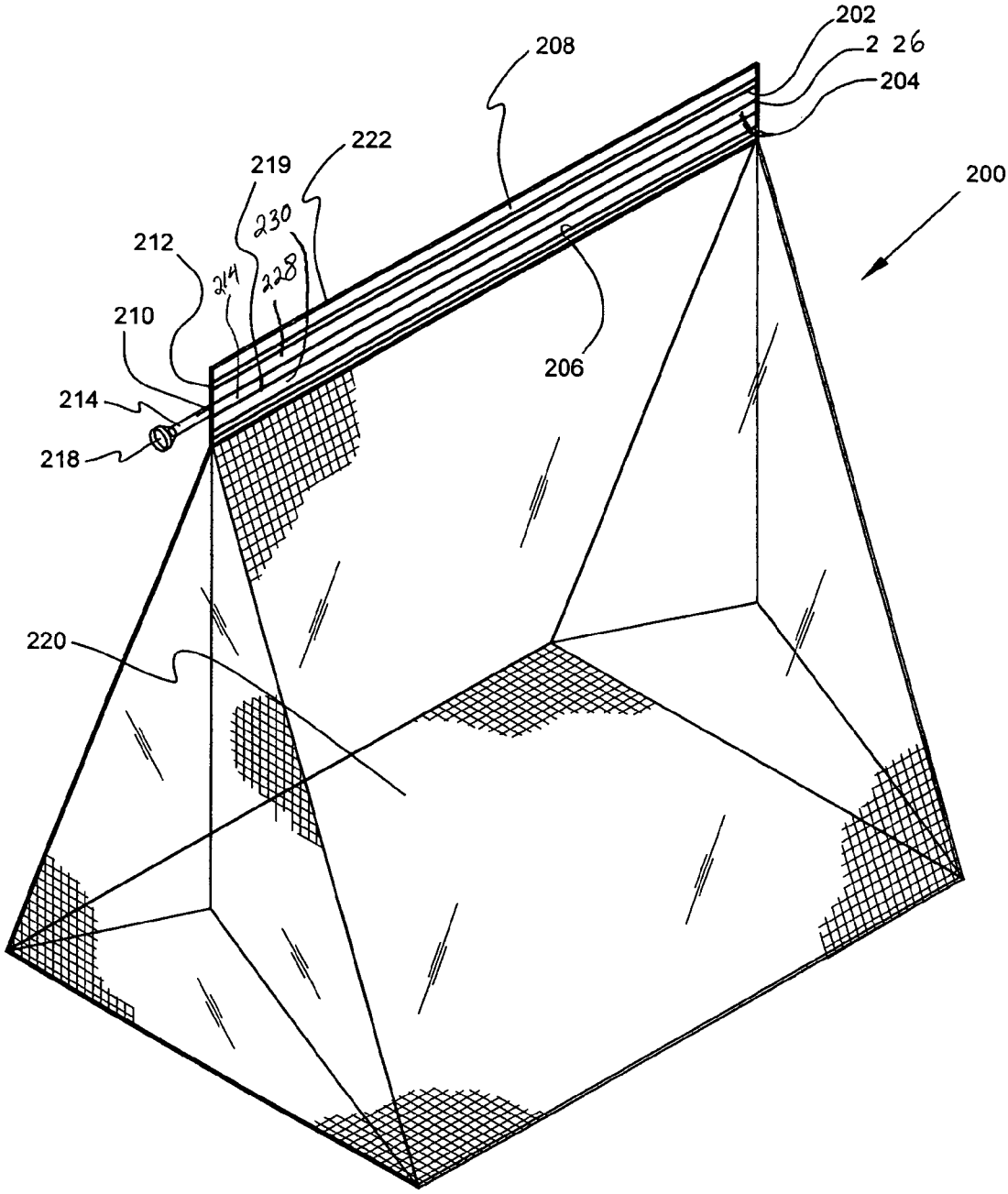
FIG. 14 is a perspective view of another alternative design for an enclosure for preserving perishable goods in accordance with the present invention.
Figure 15:
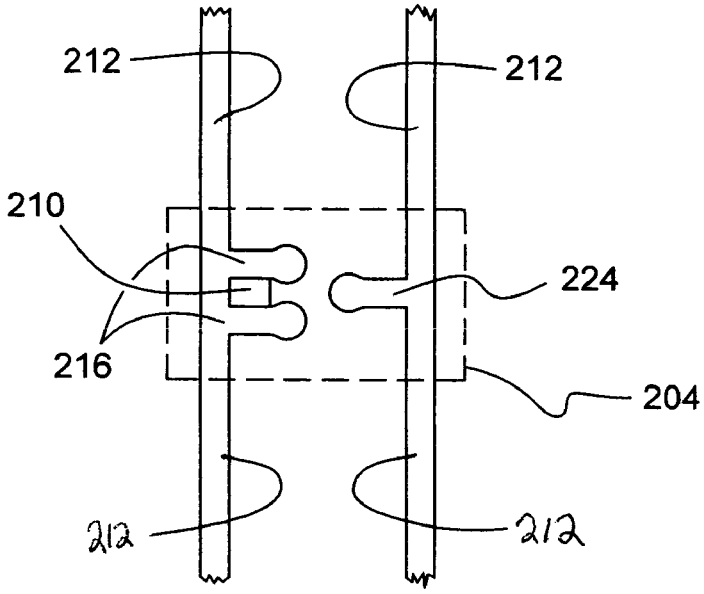
FIG. 15 is a cutaway side view of a second locking seal of the enclosure of FIG. 14, the second locking seal being in an open position.
Figure 16:
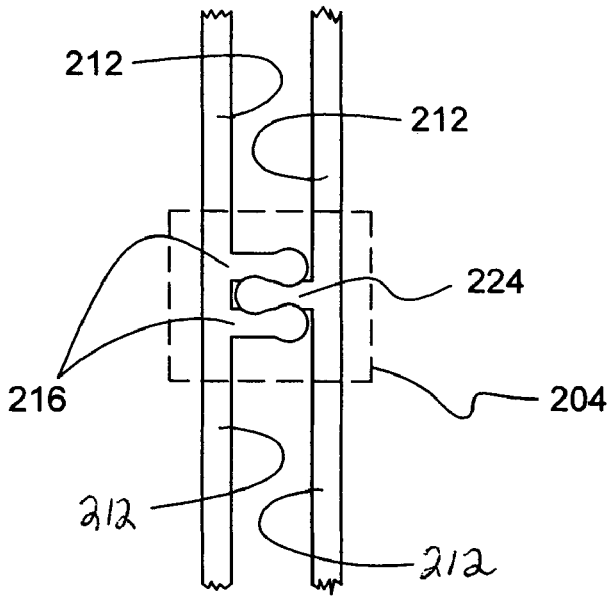
FIG. 16 is the same cutaway side view of FIG. 15, but with the enclosure in a closed position.
Figure 17:
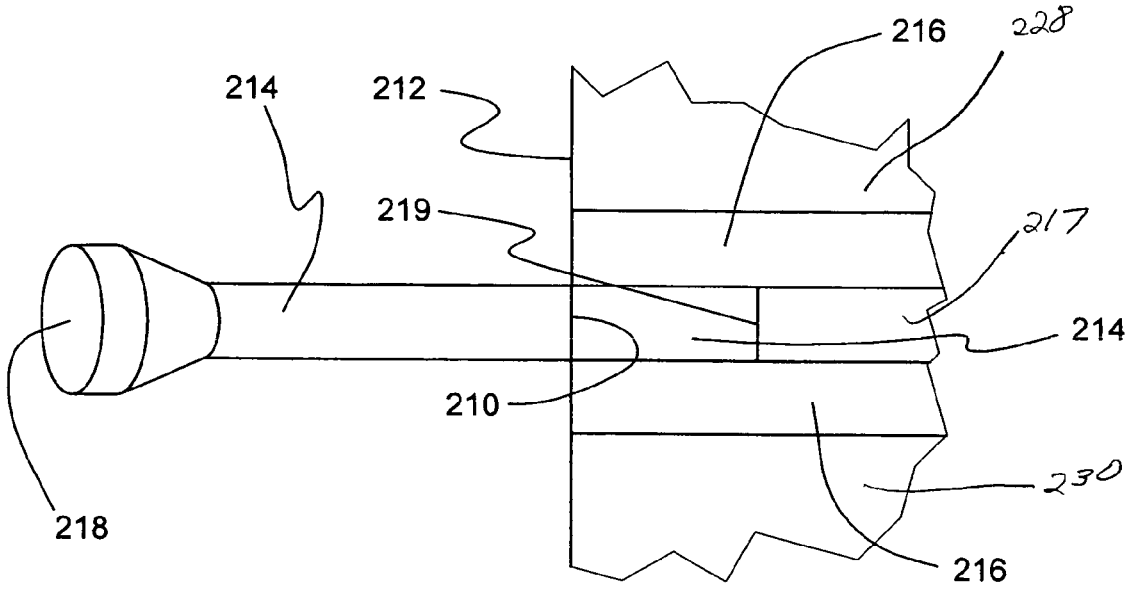
FIG. 17 is a cutaway front view of a first side portion of a second locking seal of the enclosure of FIG. 14 with an air evacuation tube inserted therein.
Figure 18:
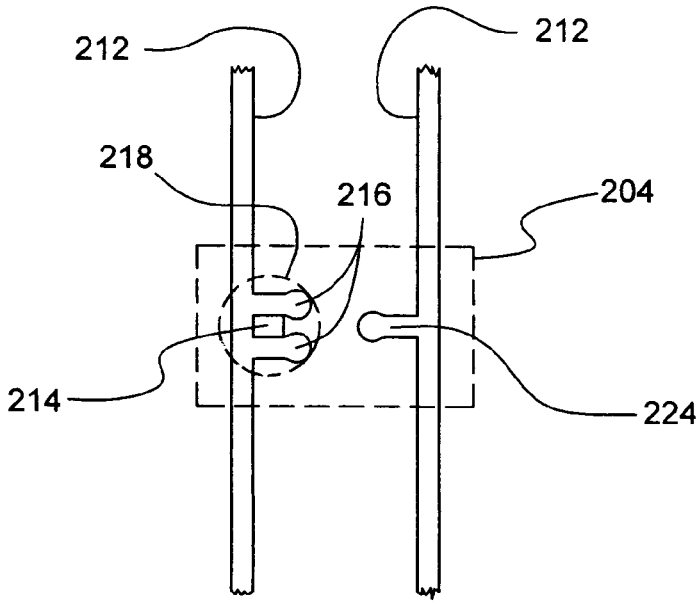
FIG. 18 is the same cutaway side view of FIG. 15, but with the air evacuation tube of FIG. 17 inserted therein, the air evacuation tube depicted in a phantom rather than solid view.

Referring now to FIG. 13, an alternative bag or food enclosure in accordance with the present invention, is depicted and denoted as numeral 100. The alternative bag 100 is designed to stand upright while removing air from within thereby promoting the removal of air without drawing the bag 100 into the vacuum suction port. The bag 100 includes an inner portion 102, an outer portion 106, an outer seal 108, an inner seal 110, gripping flaps 112, a bottom wall 114, two side walls 116 and two end walls 118. The inner and outer portions 102 and 106 cooperate with a vacuum portion 72 to remove air from the inner portion 102 by disposing the orifice 84 of the vacuum portion 72 between the outer and inner seals 108 and 110. Upon removing the air from the inner portion 102, the inner seal 110 is closed, the tube member 82 of the vacuum portion 72 removed, and the outer seal closed to prevent air from seeping into the bag 100. An added seal 120 is provided in the gripping flaps 112 to further restrict air from seeping into the bag 100. Outer portions 122 of the gripping flaps 112 are sufficiently sized to grasp and forcibly open the added seal 120 and ultimately the outer and inner seals 108 and 110 to gain access to the frozen contents inside the bag 100.

The upright stance of the bag 100 is accomplished by incorporating a triangular configuration into the end walls 118. Triangular configured seams 124 are included in the end walls 118 to promote the collapsing of the end walls 118 as air is forcibly sucked from the bag 100. As air is removed from the bag 100, the end walls 118 start collapsing inward at a central point 126 in the seams 124. The end walls 118 continue to collapse until the central points 126 engage the food goods to be frozen, whereupon, the bottom and side walls 114 and 116 are drawn inward until engaging the food goods and the end walls 118. The initial collapsing of the end walls 118 of the bag 100 prevents the side walls 114 from first collapsing and being drawn into the orifice 84 of the vacuum portion 72 before the air has been removed from the bag 100 thereby promoting a complete vacuum of the bag 100 and the preservation of the food goods therein.

Referring now to FIGS. 14-18, an alternative food storage enclosure in accordance with the present invention is depicted as numeral 200. The enclosure 200 includes a configuration substantially similar to the enclosure depicted in FIG. 13, but with first, second and third (rather than two) locking seals 202, 204 and 206 extending parallel across a top portion 208 of the enclosure 200. The enclosure further includes an aperture 210 in a first side portion 212 of the enclosure 200 adjacent to the second locking seal 204. The aperture 210 allows an air evacuation tube 214 to snugly insert through the side portion 212 and in between two first ridges 216 of the second locking seal 204.

The first ridges 216 of the second locking seal 204 are relatively larger and more rigid than the first ridges of the first and third locking seals 202 and 206. The first ridges 216 of the second locking seal 204 are sized to snugly receive therebetween the evacuation tube 214 which includes a rectangular outer configuration that cooperates with the substantially rectangular gap 217 between the first ridges 216 to promote the snug insertion of the tube 214 between the ridges 216. The evacuation tube 214 is dimensioned to promote the relatively fast removal of air from inside the enclosure 200 when a vacuum device (not pictured) is cooperatively coupled to an enlarged suction port 218 of the evacuation tube 214. Further, the size, rigidity and configuration of the first ridges 216 of the second locking seal 204 cooperate with the evacuation tube 214 to prevent adjacent portions 228 and 230 of the enclosure 200 from being sucked into a suction end 219 of the air evacuation tube 214 when the vacuum device is energized.

In operation, a perishable food item is disposed inside an inner portion 220 of the enclosure 200 via a top opening 222. The first locking seal 202 is then sealed shut while the second and third seals 204 and 206 remain open. The evacuation tube 214 is then inserted through the aperture 210 and between the first ridges 216 of the second seal 204. A vacuum device is coupled to the suction port 218 of the evacuation tube 214 whereupon the vacuum device is energized and all air is removed from all portions of the enclosure 200. The third locking seal 206 is then sealed closed while the suction device is energized. The second locking seal 204 is then sealed closed by forcibly joining (see FIG. 16) the first ridges 216 with a second ridge 224 starting at a second side portion 226 of the enclosure 200 and continuing the sealing operation until the second ridge 224 engages the suction end 219 of the evacuation tube 214 disposed between the first ridges 216. The evacuation tube 214 is then forcibly "squeezed" from between the first ridges 216 and out of the enclosure 200 by continuing the forcible insertion of the second ridge 224 between the first ridges 216 until the second locking seal 204 is totally sealed closed thereby preventing air from re-entering the enclosure 200 via the aperture 210 due to the second ridge 224 "plugging" the aperture 210.

Thus, the second locking seal 204 promotes the removal of all air from inside the enclosure 200 between the first and third locking seals 202 and 206 after the enclosure has been initially sealed to protect the perishable items via cooperatively sealing the first and third locking seals 202 and 206. The removal of all air from the enclosure 200 plus the prevention of air from re-entering the enclosure 200 after de-energizing the air removal device, increases preservation capability of the enclosure 200 when freezing the perishable items inside the enclosure 200.

The foregoing description is for purposes of illustrating only and is not intended to limit the scope of protection accorded this invention. The scope of protection is to be measured by the following claims, which should be interpreted as broadly as the inventive contribution permits.

The invention claimed is:

1. A freezer bag comprising:

a first seal having two first ridges that snugly receive an opposite second ridge;

a second seal having two first ridges that snugly receive an opposite second ridge;

a third seal having two first ridges that snugly receive an opposite second ridge;

an air evacuation tube secured to an end portion of said second seal; and, wherein said first ridges of said second seal are rigid relative to said first ridges of said first and third seals.

2. The enclosure of claim 1 wherein said air evacuation tube includes a rectangular outer configuration.

3. The freezer bag of claim 2 wherein said second seal includes a substantially rectangular gap between said first ridges to promote the snug insertion of said air evacuation tube between said first ridges.

4. The enclosure of claim 3 wherein said second locking seal includes a substantially rectangular gap between said first ridges to promote the snug insertion of said evacuation tube between said first ridges.

5. A vacuumed enclosure for preserving food comprising:

a first seal disposed adjacent and parallel to an opening;

a second seal disposed adjacent and parallel to said first seal, said second seal defining an outer portion of said enclosure, and including two first ridges;

a third seal disposed adjacent and parallel to said second seal, said third seal defining an inner portion of said enclosure for receiving food and a middle portion of said enclosure; and means for removing air from said enclosure via said second seal such that said outer, inner and middle portions of said enclosure contain vacuums, wherein said air removing means includes a rectangular outer configuration and wherein said second seal includes a substantially rectangular gap between said first ridges of said second seal to promote the snug insertion of said air removing means between said first ridges.

6. The vacuumed enclosure of claim 5 wherein said air removing means includes an air evacuation tube.

7. The vacuumed enclosure of claim 5 wherein said second seal includes rigid first ridges relative to first ridges of said first and third seals.

8. An enclosure for preserving perishable goods comprising:

a plastic bag with an opening;

a first locking seal disposed relatively close and substantially parallel to said opening;

a second locking seal disposed adjacent and parallel to said first locking seal, said second locking seal having relatively larger dimensions than said first locking seal;

a third locking seal disposed adjacent and parallel to said second locking seal, said third locking seal having dimensions substantially similar to said first locking seal, said third locking seal forming an inner portion for removably receiving perishable goods; and an aperture disposed in a first side portion of said enclosure adjacent to said second locking seal, said aperture enabling an air evacuation tube to snugly insert through said first side portion and between two first ridges of said second locking seal whereby an air removal device removes air from said enclosure after perishable goods are placed in said inner portion and said first locking seal is closed, whereupon said third locking seal is closed followed by said second locking seal closing from a second side of said enclosure to said first side of said enclosure until the evacuation tube is forcibly squeezed from said enclosure via said aperture, the sealing of said second locking seal preventing air from re-entering said enclosure via said aperture.

9. The enclosure of claim 8 wherein said first locking seal includes two first ridges that removably receive therebetween an opposite second ridge thereby sealing said first locking seal.

10. The enclosure of claim 8 wherein said third locking seal includes two first ridges that removably receive therebetween an opposite second ridge thereby sealing said third locking seal.

11. The enclosure of claim 8 wherein said air evacuation tube includes an outer rectangular configuration.

12. The enclosure of claim 8 wherein said second locking seal includes rigid first ridges relative to first ridges of said first and third locking seals.

13. The enclosure of claim 8 wherein said air evacuation tube includes a rectangular outer configuration.

14. The enclosure of claim 8 wherein said second locking seal includes an opposite second ridge that ultimately inserts between said two first ridges.

* * * * *